US008349109B2

(12) United States Patent
Al-Emrani et al.

(10) Patent No.: US 8,349,109 B2
(45) Date of Patent: Jan. 8, 2013

(54) METHOD FOR APPLYING A REINFORCED COMPOSITE MATERIAL TO A STRUCTURAL MEMBER

(76) Inventors: Mohammad Al-Emrani, Lindome (SE); Robert Kliger, Västra Frölunda (SE); Reza Haghani, Göteborg (SE)

( * ) Notice: Subject to any disclaimer, the term of this patent is extended or adjusted under 35 U.S.C. 154(b) by 352 days.

(21) Appl. No.: 12/665,770

(22) PCT Filed: Jun. 27, 2008

(86) PCT No.: PCT/SE2008/050792

§ 371 (c)(1),
(2), (4) Date: Dec. 21, 2009

(87) PCT Pub. No.: WO2009/002268

PCT Pub. Date: Dec. 31, 2008

(65) Prior Publication Data

US 2011/0000606 A1 Jan. 6, 2011

(30) Foreign Application Priority Data

Jun. 27, 2007 (SE) ..... 0701574

(51) Int. Cl.
*B32B 37/00* (2006.01)

(52) U.S. Cl. ..... 156/71; 156/160; 156/229

(58) Field of Classification Search ..... 156/71, 156/160, 163, 161, 164, 229
See application file for complete search history.

(56) References Cited

U.S. PATENT DOCUMENTS 6,385,940 B1 5/2002 Maier et al.
6,464,811 B1 * 10/2002 Meier et al. ..... 156/71

FOREIGN PATENT DOCUMENTS

KR 10-0653632 B1 * 12/2006

OTHER PUBLICATIONS

Czaderski, et al "40-Year-old full-scale concrete bridge girder strengthened with prestressed CFRP plates anchored using gardient method", Composites: Part B 38 (2007) 878-886, Jan. 18, 2007.*

* cited by examiner

*Primary Examiner* — Jeff Aftergut
(74) *Attorney, Agent, or Firm* — Hamre, Schumann, Mueller & Larson, P.C.

(57) ABSTRACT

Method for applying a reinforced composite material, such as a fibre reinforced polymer (FRP) laminate or a steel reinforced polymer (SRP) laminate or a steel reinforced grout (SRG) composite, to a structural member. The method comprises the steps of: applying a curable adhesive to a surface of the structural member and/or a surface of the reinforced composite material, and bringing said surfaces into contact. A pre-stressing force, $P_{max}$, is directly or indirectly applied to the reinforced composite material. The pre-stressing force, $P_{max}$, to which a treatment length, $L_T$, of the reinforced composite material is subjected is then decreased so that the reinforced composite material along the treatment length, $L_T$, will be less pre-stressed than the reinforced composite material adjacent to the treatment length, $L_T$, when the adhesive has cured.

16 Claims, 3 Drawing Sheets

METHOD FOR APPLYING A REINFORCED COMPOSITE MATERIAL TO A STRUCTURAL MEMBER

TECHNICAL FIELD

The present invention concerns a method for applying a reinforced composite material, such as a fibre reinforced polymer (FRP) laminate or a steel reinforced polymer (SRP) laminate or a steel reinforced grout (SRG) composite, to a structural member, such as a part of a bridge, building, vehicle or any other structural member that needs to be strengthened or repaired.

BACKGROUND OF THE INVENTION

A fibre-reinforced polymer (FRP) is a composite material comprising a polymer matrix reinforced with fibres. The fibers are usually glass, carbon, aramid or metallic fibres, such as steel fibres, while the matrix is usually an epoxy, vinylester, nylon or polyester thermosetting plastic. FRPs are typically organized in a laminate structure, such that each lamina contains an arrangement of unidirectional fibres or woven fibre fabrics embedded within a thin layer of light polymer matrix material. The fibres provide the strength and stiffness. The matrix binds and protects the fibers from damage and transfers the stresses between fibers.

FRP laminates have the ability to sustain a load without excessive deformation or failure, and because they respond linear-elastically to axial stress, i.e. when an FRP laminate is relieved of an applied axial tension it will return to its original shape or length. FRP laminates have a high strength to weight ratio, high creep resistance, a high modulus of elasticity (up to 450 GPa for example), high corrosion resistance, they can survive harsh environments and can be formed into complex shapes.

It is known that the benefits of an FRP laminate may be increased by pre-stressing the FRP laminate before bonding it to a structural member. An FRP laminate is namely pre-stressed and bonded to a structural member using an adhesive while maintaining the stressing force. The stressing force is released when the adhesive has hardened or cured. Pre-stressing the laminates before bonding them to structural members has several advantages. When bonding a pre-stressed FRP laminate to a concrete structure these advantages include:

- a reduction in deformations due to live loads and thus performance enhancement in the serviceability limit state,
- crack width reduction on the tensile part of the structure and consequently an increase in durability
- the provision of a negative moment against dead loads and more capacity for live loads, and
- a compensation for the lost pre-stress in a pre-stressed concrete structure (due to the corrosion or damage of tendons for example).

When bonding an FRP laminate to a steel structure the advantages include the enhancement of the fatigue strength of the steel structure and the prevention of fatigue crack formation or propagation in the steel structure.

A problem when using bonded pre-stressed FRP laminates when repairing or strengthening a structural member is that high shear stresses may build up at the ends of FRP laminate in the adhesive layer that bonds the FRP laminate to the structural member. These shear stresses are normally several times higher than the strength of conventional adhesives, such as epoxy resins, that are used to bond the FRP laminate to the structural member. Shear stresses of 100-150 MPa can for example arise at the ends of an FRP laminate, whereas conventional adhesives can withstand only shear stresses of 20-25 MPa. The shear stresses may give rise to delamination or debonding of the FRP laminate from the structural member, whereby the delaminating or de-bonding may be initiated at the ends of the FRP laminate and propagates inwards from the ends of the FRP laminates. De-bonding limits the capacity of the strengthening system below its ultimate flexural capacity and this failure mode can be characterized by a sudden separation of the FRP laminate from the structural member rather than by the ultimate flexural capacity of the cross section of the strengthened structure.

Mechanical anchors are usually used to solve the problem of high shear stresses at the FRP laminate ends. However, there are several problems associated with using a mechanical anchoring system. Mechanical anchors are in many cases rather complicated, time-consuming and costly to manufacture, install and inspect. They often need to be manufactured with very close dimensional tolerances for the specific structural member to be strengthened. The structural member on which they are mounted often needs to be modified (a part of the structural member may need to be cut out and removed and bolts may have to be drilled into the structural member and fixed in place using adhesive or mortar bonding for example). The mechanical anchors may be susceptible to moisture and dust accumulation which may result in the corrosion of the anchoring system. Furthermore, galvanic corrosion may take place when metal anchors are used to repair or strengthen a structure comprising a dissimilar metal. Additionally, the drilling of steel structures to install the mechanical anchors is inevitable. In some cases, where the aim of using pre-stressed laminates is fatigue strength enhancement, drilling holes in a structure which are normally situated in a high moment area, could cause new fatigue-prone points in the structure.

U.S. Pat. No. 6,464,811 discloses a method of reinforcing a construction part with lamellar, fibre-reinforced plastic strips. The lamellar strips are pre-tensed with a tensioning device, treated with adhesive in a pre-tensed state and then moved to the construction part to be treated together with a tension device. The tension device is provisionally fixed to the construction part with displaceable fixing devices. Thereafter, the lamellar strips are pressed against the construction by means of an air bag or air hose until the adhesive has hardened. This patent discloses that the strips may be pre-stressed by different amounts by pre-tensing a first part of the strip using a first tension and adhering that first part of the strip to the construction part, and then, once the adhesive has cured, pre-tensing a second part of the strip using a second tension and then adhering that second part of the strip to the construction part. This method is however quite time consuming and complex, especially if long strip lengths are used, and, if an existing structure, such as a bridge, is being reinforced; it could be out of service for a considerable period of time.

SUMMARY OF THE INVENTION

An object of the present invention is to provide an improved method for applying a reinforced composite material, such as a fibre reinforced polymer (FRP) laminate or a steel reinforced polymer (SRP) or a steel reinforced grout (SRG) composite (i.e. a composite comprising steel cords formed from interwoven steel wires embedded within a polymer resin or cementitious grout matrix), to a structural member, such as at least part of a bridge (such as the span, a column, tendon, girder or hanger), a building (such as a wall, pillar, floor or roof), a vehicle or any other monolithic or polylithic structure in order to repair or strengthen the structural member.

This object is achieved by a method comprising the steps of applying a curable adhesive, such as an epoxy resin or any other suitable curable adhesive, to a surface of the structural member and/or a surface of the reinforced composite material, bringing the surfaces into contact and directly or indirectly applying a pre-stressing force, $P_{max}$ to the reinforced composite material. The pre-stressing force may be applied using a hydraulically or mechanically operated piston-cylinder unit or by means of a screw link actuator or simply by means of a screw for example. The pre-stressing force, $P_{max}$, to which a treatment length, $L_T$, of the reinforced composite material is subjected, is then decreased so that the reinforced composite material along the treatment length, $L_T$, will be less pre-stressed than the reinforced composite material adjacent to the treatment length, $L_T$, when the adhesive has cured.

This method allows pre-stressed reinforced composite materials having a non-uniform pre-stressing to be used for the internal and/or external reinforcement of existing structures or for the reinforcement of structures under construction without having to use permanent mechanical anchors and thus avoiding the above-mentioned problems associated with permanent mechanical anchors. The pre-stressing process is simple, reliable and cost-effective and takes a short time, which limits disruptions and delays while repair or reinforcement work is taking place, such as disruptions and delays in the traffic flow over a heavily traficated bridge for example, which can otherwise present a major problem when using conventional methods.

Very high pre-stressing forces (up to 1500 MPa) can be applied to the reinforced composite material without concentrating interfacial stresses along the adhesive layer between the structural member and the reinforced composite material at the ends of the reinforced composite material. The reinforced structural member will be less prone to slip deformations and environmental attacks due to the lower state of stress in the adhesive layer, which improves the safety and performance of the strengthening system and increases its useful lifetime.

Finite element analysis of this method has confirmed that the magnitude of critical shear and peeling stresses at the ends of a pre-stressed reinforced composite material can be reduced by a factor of ten as compared to conventional methods in which an reinforced composite material is adhered to a structural member in uniformly pre-stressed state. Shear and peeling stresses at the ends of a pre-stressed reinforced composite material may in fact be eliminated all together by leaving part of the laminate at the end stress-free.

It should be noted that the expression "reinforced composite material laminate" is intended to include any type of laminate structure, such as a sheet- or strip-like structure of any shape, size and thickness or a cable-like structure of any cross-sectional shape and comprising any type of fibre and matrix.

According to an embodiment of the invention the method comprises the step of decreasing the pre-stressing force, $P_{max}$, to which a treatment length $L_T$, of the reinforced composite material is subjected in a continuous or step-wise manner so that the reinforced composite material along the treatment length, $L_T$, will comprise a plurality of length sections each having a different pre-stressed state when the adhesive has cured.

According to another embodiment of the invention the method the treatment length $L_T$, is a length at an end of the reinforced composite material, i.e. the treatment length $L_T$ continues to the very end of an reinforced composite material or stops just short of the end of the reinforced composite material.

According to a further embodiment of the invention the method comprises the steps of: clamping at least one part of the reinforced composite material (its middle or one or both of its ends for example), to the structural member or in a pre-stressing device for example and applying a pre-stressing force to the reinforced composite material. Means to hinder/prevent at least one length section of the reinforced composite material from being displaced in a direction opposite to the direction of application of the pre-stressing force are then provided.

The means to hinder/prevent the at least one length section of the reinforced composite material from being displaced in a direction opposite to the direction of application of the pre-stressing force may be provided by: attaching at least one protrusion, such as at least one stop block or at least one series of stop blocks, to the reinforced composite material, whereby, when a plurality of blocks are used they are spaced a predetermined distance apart, by adhesion for example, before or after the reinforced composite material has been clamped and/or before or after the pre-stressing force has been applied. A displacement-limiting means is then provided to prevent the at least one protrusion from being displaced beyond a predetermined distance in the direction opposite to the direction of application of the pre-stressing force while the pre-stressing force is being decreased. The at least one protrusion may be attached to the reinforced composite material in the vicinity of at least one of its ends.

According to an embodiment of the invention the displacement-limiting means comprises a mould having at least one recess that has a side wall, whereby the at least one recess is arranged to receive the at least one protrusion and the at least one protrusion is arranged to be displaced in the recess in a direction opposite to the direction of application of the pre-stressing force until it reaches the side wall, while the pre-stressing force is being decreased. According to an embodiment of the invention the mould comprises a plurality of the recesses, such as three to ten recesses, or three to ten pairs of recesses, whereby the width of each recess increases in the direction of application of the pre-stressing force.

Accordinng to a further embodiment of the invention the mould is a polylithic structure that enables at least one side wall to be releasably or non-releasably secured in more than one position along the mould. This means that the width of the recesses of the mould may be adjusted depending on the type of laminate and the pre-stressing force being used in a particular application. Such a mould may of course be used in a method according to any of the embodiments of the invention.

According to an alternative embodiment of the invention such displacement-limiting means is used to indirectly apply a pre-stressing force to the reinforced composite material, whereby at least one part of the displacement-limiting means (and not the reinforced composite material) is clamped in a pre-stressing device for example, and a pre-stressing force is applied to the displacement-limiting means, whereby the pre-stressed state of the displacement-limiting means is consequently transferred to the reinforced composite material.

The present invention also concerns a method for applying a fibre reinforced polymer (FRP) laminate to a structural member, comprising the steps of: subjecting an reinforced composite material to a non-uniform pre-stressing$_l$, and adhering the reinforced composite material to the structural member in a pre-stressed state, whereby the pre-stressing force to which a length, $L_C$, of the reinforced composite material is subjected is increased so that the reinforced composite material along that length, $L_C$, will be more pre-stressed than the reinforced composite material along a length section, $L_T$, adjacent to that length $L_C$, when the adhesive has cured.

According to another embodiment of the invention the method comprises the step of increasing the pre-stressing force to which a length, $L_C$, of the reinforced composite material is subjected in a continuous or step-wise manner so that the reinforced composite material along that length, $L_C$, will comprise a plurality of length sections each having a different pre-stressed state when the adhesive has cured.

According to another embodiment of the invention the length, $L_C$, is a length at the centre of the reinforced composite material.

According to a further embodiment of the invention the method comprises the step of: indirectly applying a pre-stressing force, $P_{max}$ to the reinforced composite material by attaching at least one protrusion, such as at least one stop block or at least one series of stop blocks, to the reinforced composite material, by adhesion for example. A mould comprising at least one recess having a side wall is provided, whereby the at least one recess is arranged to receive the at least one protrusion and the side wall of the at least one recess is arranged to come into contact with the at least one protrusion at some stage during the application of the pre-stressing force, i.e. before the pre-stressing force is being applied or while the pre-stressing force is being applied, and then applying a pre-stressing force to the mould. The pre-stressing force is thereby transferred to the reinforced composite material via the action of the side wall(s) of the at least one recess of the mould on the at least one protrusion.

According to an embodiment of the invention the mould comprises a plurality of recesses, such as three to ten recesses, whereby the width of each recess decreases in the direction of application of the pre-stressing force.

The present invention also concerns a method for applying a fibre reinforced polymer (FRP) laminate to a structural member, which comprises the steps of: subjecting a structural member to non-uniform pre-stressing along a length, $L_{total}$, and adhering the reinforced composite material to the structural member in a non-stressed state.

According to an embodiment of the invention the structural member is subjected to a non-uniform pre-stressing along a length, $L_{total}$ by: installing at least one mechanical post in the structural member, connecting a pre-stressing rod or some other pre-stressing means, to the at least one mechanical post, and applying a pre-stressing force to the at least one mechanical post.

According to an embodiment of the invention the reinforced composite material is a carbon fibre reinforced polymer (CFRP) in fabric, pre-impregnated or pre-cured laminate form for example. The favourable characteristics of CFRP laminates have caused a rapid increase in the quantity and quality of CFRP material being produced and a reduction in the cost of CFRP material is therefore forecasted.

According to another embodiment of the invention the method comprises the step of fast curing the adhesive between the reinforced composite material and the structural member, by heating the adhesive for example. Alternatively, the method comprises the step of curing the adhesive between the reinforced composite material and the structural member at ambient temperature.

The methods according to any embodiment of the invention are intended for use particularly, but not exclusively in the aerospace, automotive, marine, and construction industries. The method may be used to increase the working load of a structure or to alter its structural form by removing supporting elements such as pillars, or by reducing the supporting function of such elements. It may be used to strengthen elements at risk from fatigue stress, increase rigidity, compensate damage to the support system of a structure or to renovate an existing construction, or effect post-construction reinforcement in the event of faulty calculation or execution of a particular construction.

BRIEF DESCRIPTION OF THE DRAWINGS

The present invention will hereinafter be further explained by means of non-limiting examples with reference to the appended schematic figures where.

It should be noted that the drawings have not been drawn to scale and that the dimensions of certain features have been exaggerated for the sake of clarity.

DETAILED DESCRIPTION OF EMBODIMENTS

Figure 1:
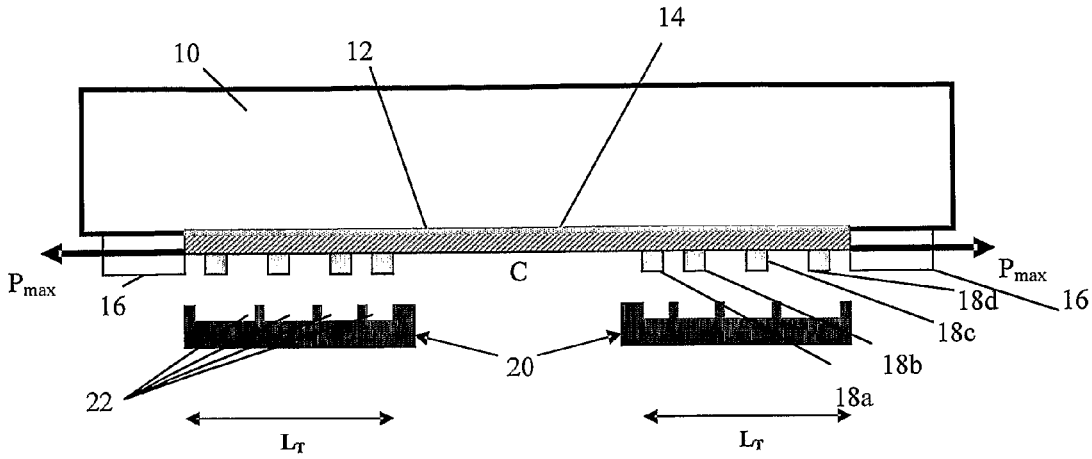
FIG. 1 shows a structural member to which an FRP laminate is being applied using a method according to a first embodiment of the invention.

FIG. 1 shows a structural member 10, in the form of a beam constituting part of the span of a bridge for example. An FRP laminate 12 in the form of a lamellar strip, such as a pre-cured CFRP laminate, has been applied to the structural member by coating a surface of the structural member 10 with a continuous or discontinuous layer of curable adhesive 14 and pressing the FRP laminate 12 against the adhesive-coated surface. The FRP laminate 12 is applied to the bottom surface of the structural member 10 so that its fibres are parallel to the structural member's longitudinal axis.

A pre-stressing force, $P_{max}$ is then applied to each end of the FRP laminate 12 using a pre-stressing device 16 comprising two lockable units located in the vicinity of the ends of the FRP laminate 12 and attached to the structural member 10 for example. The exact degree of pre-stressing may be measured with strain gauges positioned on the FRP laminate 12, or by means of an integral force measuring device housed in the pre-stressing device 16. Two series of stop blocks 18 are glued to the FRP laminate 12 at a pre-determined distance from the ends of the FRP laminate 12.

The pre-stressing force, $P_{max}$, is then decreased gradually in a continuous or step-like manner. While the pre-stressing force is being decreased, two moulds 20 that comprise a plurality of recesses 22 are fixedly arranged so as to prevent each stop block 18 from being displaced beyond a predetermined distance in the direction opposite to the direction of application of the pre-stressing force, $P_{max}$. Each recess 22 in the mould 20 is namely arranged to receive one stop block 18. While the pre-stressing force is being decreased, the stop blocks 18 on the right-hand side of FIG. 1 are displaced to the left towards the centre C of the FRP laminate 12 and the stop blocks 18 on the left-hand side of FIG. 1 are displaced to the right towards the centre C of the FRP laminate 12 until the centre-most side wall 24 of each recess 22 prevents further movement of a corresponding stop block 18 towards the centre C of the FRP laminate 12. A treatment length, $L_T$, at each end of the FRP laminate 12 will therefore be less pre-stressed than the FRP laminate 12 section at the centre C once the adhesive 14 has cured.

After curing of the adhesive 14, the pre-stressing device 16 is detached from the structural member 10 and the moulds 20 and the stop blocks 18 are preferably removed. Using this method a non-uniform axial force is created along the treatment length $L_T$ at each end of the FRP laminate 12, which decreases in the direction from the centre C of the FRP laminate to its ends, which causes a significant reduction in shear stress at the very ends of the FRP laminate 12.

A mould 20 that is suitable for use in the method illustrated in FIG. 1 is shown in more detail in FIG. 2A. The illustrated mould 20 comprises four recesses 22*a*-22*d* of different widths, D to D+3d, whereby the mould 20, when in use, is arranged so that the width of each recess 22*a*-22*d* increases in the direction of application of the pre-stressing force. The mould 20 may be placed at the right-hand end of the FRP laminate 12 in FIG. 1, when four stop blocks 18*a*-18*d* each having a width D have been glued to the FRP laminate 12. The centre-most stop block 18*a* will be received in the centre-most recess 22*a* which also has a width and will thus be prevented from moving any further towards the centre C of the FRP laminate 12. The second stop block 18*b* will be prevented from moving any further towards the centre C of the FRP laminate 12 once the end of FRP laminate 12 has moved a distance d towards the centre of the FRP laminate 12 etc. The FRP laminate 12 will therefore be pre-stressed in a step-wise manner along the treatment length $L_T$. It should be noted that the number, location and dimensions of the recesses 22*a*-22*d* along the mould 20 and the number, location and dimensions of stop blocks 18 along the FRP laminate 12 will of course depend on the pre-stressing profile that it is desired to obtain along the FRP laminate 12, which in turn depends on the particular application.

FIG. 2A shows a solid mould 20 that can be used for a specific type of laminate when applying a specific pre-stressing force. Alternatively a polylithic mould may be used in a method according to an embodiment of the invention. The mould 20 shown in FIG. 2B comprises movable blocks 18 that may be releasably, or non-releasably secured, by means of bolts 23 for example, at any position along the length of the mould 20. The space 22 between the blocks 18 may therefore be adjusted depending on the type of laminate and the pre-stressing force being used in a particular application.

Figure 2:
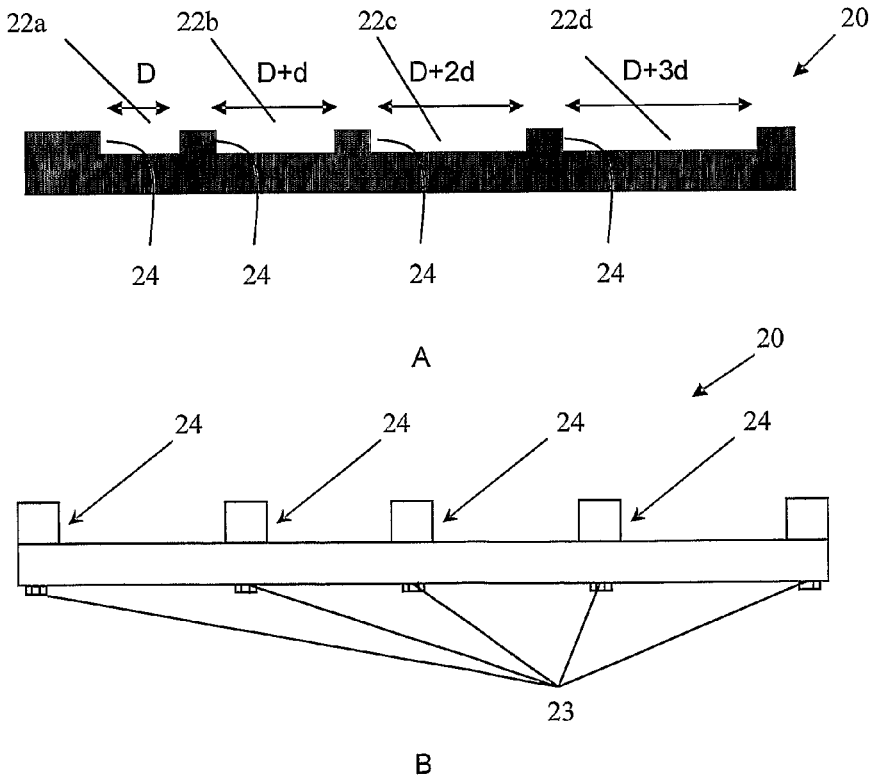
FIG. 2 shows examples of two moulds that can be used in the method of FIG. 1.
Figure 3:
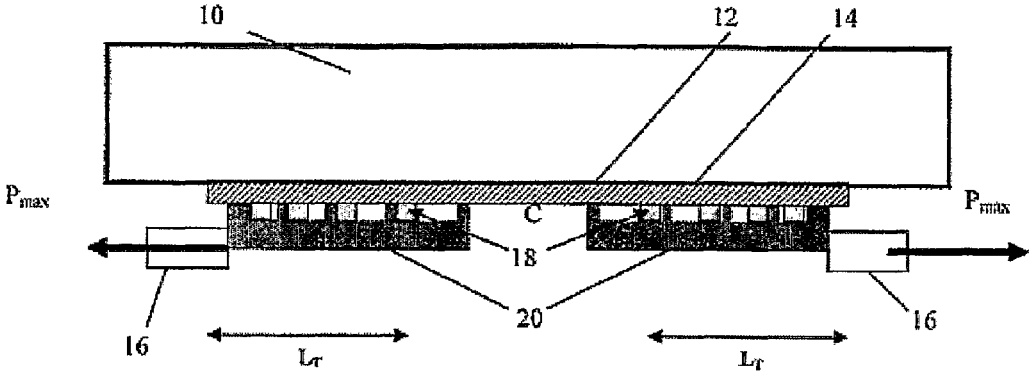
FIG. 3 shows a structural member to which an FRP laminate is being applied using a method according to a second embodiment of the invention.

FIG. 3 schematically shows an alternative method for applying an FRP laminate 12 to a structural member 10 which is similar to the method described in conjunction with FIGS. 1 and 2 but where the ends of the mould 20 (and not the ends of the FRP laminate 12) are clamped in a pre-stressing device 16 for example. The mould at the right-hand side of FIG. 3 is placed in the opposite direction to that shown in FIG. 2 whereas the mould at the left-hand side of FIG. 3 is placed as shown in FIG. 2. A pre-stressing force, $P_{max}$, is applied to the mould 20, whereby the pre-stressed state of the mould 20 is consequently transferred to the FRP laminate 12. The pre-stressing force, $P_{max}$, is then decreased gradually in a continuous or step-like manner. In this embodiment of the invention, the mould 20 therefore acts as both displacement-limiting means and as a means for indirectly applying a pre-stressing force to the FRP laminate 12.

According to an alternative embodiment of the invention an FRP laminate 12 may be subjected to a non-uniform pre-stressing and adhered to the structural member 10 in a non-uniformly pre-stressed state. A mould 20 may namely be used to apply an increased pre-stressing force to a length, $L_C$, of the FRP laminate 12 so that the FRP laminate 12 along that length, $L_C$, will be more pre-stressed than the FRP laminate 12 along a length section, $L_T$, adjacent to that length $L_C$, when the adhesive 14 has cured.

Figure 4:
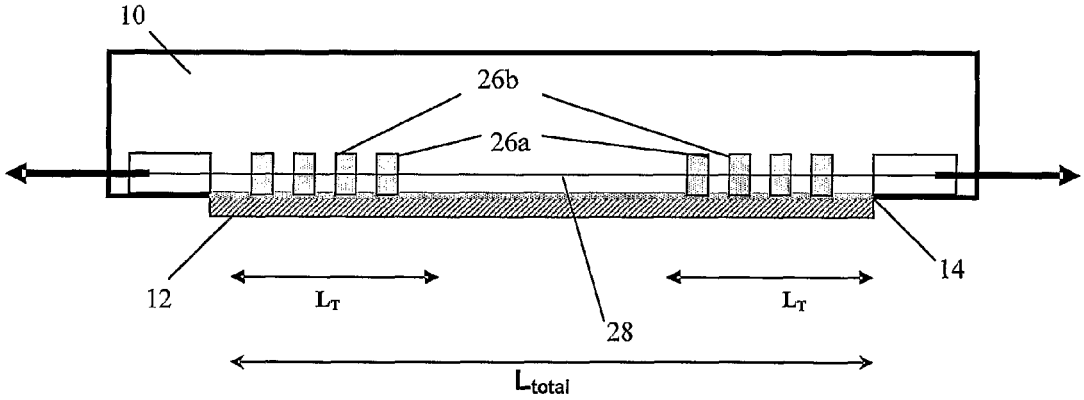
FIG. 4 shows a structural member to which an FRP laminate is being applied using a method according to a third embodiment of the invention.

FIG. 4 shows a structural member 10 to which an FRP laminate 12 is being applied using a method according to a third embodiment of the invention. The method comprises the steps of subjecting a structural member 10 to non-uniform pre-stressing along a length, $L_{total}$, and adhering the FRP laminate 12 to the structural member in a non-stressed state. The non-uniform pre-stressing of the structural member 10 may be carried out by installing a plurality of pairs of mechanical posts 26 at predetermined positions near the surface of the structural member 10, whereby the two mechanical posts 26 of each pair are located one at each end of the structural member 10, and interconnecting the mechanical posts 26 with a pre-stressing rod 28 or some other pre-stressing means. Grooves may for example be cut in the structural member the mechanical posts 26 may be mechanically and/or adhesively fastened inside each groove.

The pre-stressing in this procedure is carried out in several steps. In the first step, the total pre-stressing force, $P_{max}$, is applied to the structural member 10. Two nuts of the two inner mechanical posts 26*a* are tightened so that the pre-stressing rod 28 between the two inner mechanical posts 26*a* is maintained at the total pre-stressing force, $P_{max}$. The pre-stressing force is then reduced by a predetermined amount, such as by 20%, and the two nuts of the adjacent mechanical posts 26*b* are tightened so that the pre-stressing rod 28 between those two mechanical posts 26*b* is maintained at that reduced pre-stressing force. This procedure is continued towards the ends of the structural member 10. Once the procedure is completed, curable adhesive 14 is applied to the bottom surface of the structural member 10 and then an FRP laminate 12 is applied to that surface in a non-stressed state. Once the adhesive has cured, the pre-stressing force is released by opening the nuts of each pair of mechanical posts 26 starting with the mechanical posts 26 located closest to the ends of the structural member 10 and working inwards towards the centre, C. The pre-stressing force is thus transferred from the structure member 10 to the FRP laminate 12. Even though the structural member 10 has to be modified somewhat to install the mechanical posts 26, an advantage of this method is that neither a pre-stressing device nor a mould is required.

Figure 5:
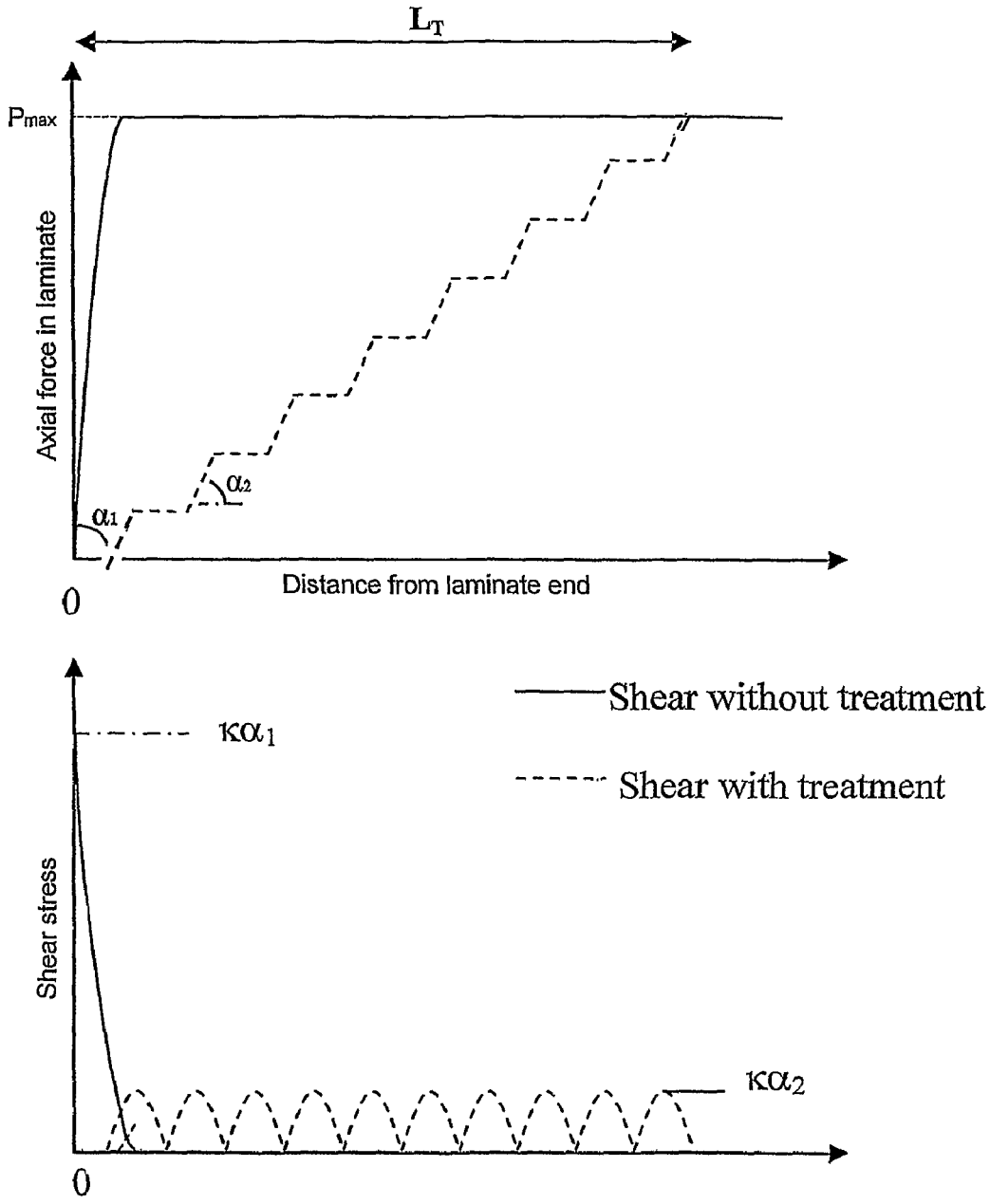
FIG. 5 shows the axial force and shear stress versus the distance from the end of an FRP laminate.

FIG. 5 shows the axial force and shear stress versus the distance from the end (0) of an FRP laminate 12 towards its centre before treatment, i.e. when a pre-stressed FRP laminate is adhered to a non-pre-stressed structural member (see the continuous lines in FIG. 5), and after treatment, i.e. when a method according to an embodiment of the invention has been used to apply an FRP laminate to a structural member (see the dashed lines in FIG. 5). Using a method according to any of the embodiments of the invention reduces the slope of the axial force curve at the ends of the FRP laminate along the treatment length $L_T$. FIG. 5 shows that the treatment length, $L_T$, is divided into several steps. The magnitude of the axial force is constant in each step. The accumulation of shear stress is thereby prevented by these constant force intervals, i.e. the steps break up the high shear stress curve and distribute it along the treatment length, $L_T$, of the FRP laminate.

It should be noted that an FRP laminate 12 need not necessarily be applied in a substantially horizontal orientation to the underside of a structure, such as a bridge, but may be applied in any position or orientation on an interior surface (such as the inside of a pipe) or an exterior surface of a structure where reinforcement is required. Furthermore, an FRP laminate 12 need not be of uniform thickness as shown in the figures, it need not be applied to a planar surface, and it may be of any shape, length and size.

Further modifications of the invention within the scope of the claims would be apparent to a skilled person. For example it would be obvious for a skilled person that a plurality of FRP laminates having their fibres aligned in different directions could be applied to a structural member using a method according to an embodiment of the invention in order to provide the desired strengthening.

The invention claimed is:

1. A method for applying a fibre reinforced polymer (FRP) laminate to a structural member, comprising:

subjecting a structural member to non-uniform pre-stressing along a length, $_{total}$, and adhering the reinforced composite material to the structural member in a non-stressed state.

2. The method according to claim 1, wherein said structural member is subjected to a non-uniform pre-stressing along a length, $L_{total}$ by:

installing at least one mechanical post in the structural member, connecting a pre-stressing rod means to said at least one mechanical post, and applying a pre-stressing force to said at least one mechanical post.

3. A method for applying a reinforced composite material, such as a fibre reinforced polymer (FRP) laminate or a steel reinforced polymer (SRP) laminate or a steel reinforced grout (SRO) composite, to a structural member, comprising:

applying a curable adhesive to at least one of a surface of the structural member and a surface of the reinforced composite material, and bringing said surfaces into contact, and directly or indirectly applying a pre-stressing force, Pmax to the reinforced composite material, wherein the method comprises:

decreasing the pre-stressing force, Pmax, to which a treatment length, LT, of the reinforced composite material is subjected so that the reinforced composite material along the treatment length, LT, will have a lower stress level than the reinforced composite material adjacent to the treatment length, LT, when the adhesive has cured, wherein said treatment length, LT , is a length at an end of said reinforced composite material, said method further comprising:

decreasing the pre-stressing force, Pmax, to which a treatment length, LT, of the reinforced composite material is subjected in a continuous or step-wise manner so that the reinforced composite material along the treatment length, LT, will comprise a plurality of length sections each having a different pre-stressed state when the adhesive has cured directly applying a pre-stressing force to the reinforced composite material, and providing means to hinder/prevent at least one length section of the reinforced composite material from being displaced in a direction opposite to the direction of application of the pre-stressing force when the pre-stressing force is being decreased, and indirectly applying a pre-stressing force to the reinforced composite material by applying the pre-stressing force, Pmax, to said means to hinder/prevent at least one length section of the reinforced composite material from being displaced beyond a predetermined distance in the direction opposite to the direction of application of the pre-stressing force, whereby the pre-stressed state of the displacement-limiting means is transferred to the reinforced composite material, wherein said means to hinder/prevent at least one length section of the reinforced composite material from being displaced beyond a predetermined distance in a direction opposite to the direction of application of the pre-stressing force are provided by:

attaching at least one protrusion, such as at least one stop block or at least one series of stop blocks, to the reinforced composite material, by adhesion for example, before or after one of the reinforced composite material has been clamped and before or after the pre-stressing force has been applied, and providing the displacement-limiting means to prevent said at least one protrusion from being displaced beyond the predetermined distance in the direction opposite to the direction of application of the pre-stressing force while the pre-stressing force is being decreased.

4. The method according to claim 3, wherein said at least one protrusion is attached to the reinforced composite material in the vicinity of at least one of its ends.

5. The method according to claim 3, wherein said displacement-limiting means comprises a mould having at least one recess having a side wall, whereby said at least one recess is arranged to receive said at least one protrusion and said at least one protrusion is arranged to be displaced in the recess in the direction opposite to the direction of application of the pre-stressing force until it reaches said side wall, while the pre-stressing force is being decreased.

6. The method according to claim 5, wherein said mould comprises a plurality of said recesses, such as three to ten recesses, whereby the width of each recess decreases in the direction of application of the pre-stressing force.

7. The method according to claim 5, wherein said mould is a polylithic structure that enables at least one side wall to be releasably or non-releasably secured in more than one position along the mould.

8. The method according to claim 3, wherein the reinforced composite material is a carbon fibre reinforced polymer (CFRP).

9. The method according to claim 3, comprising the fast curing the adhesive between the reinforced composite material and the structural member.

10. The method according to claim 3, comprising curing the adhesive between the reinforced composite material and the structural member at ambient temperature.

11. A method for applying a fibre reinforced polymer (FRP) laminate to a structural member, comprising:

increasing a pre-stressing force to which a length, LC, of the reinforced composite material is subjected in a continuous or step-wise manner so that the reinforced composite material will comprise a plurality of length sections each having a different pre-stressed state when the adhesive has cured, wherein said length, LC, is a length at the centre (C) of said reinforced composite material, subjecting the reinforced composite material to non-uniform pre-stressing by increasing the pre-stressing force to which the length, LC, of the reinforced composite material is subjected so that the reinforced composite material along that length, LC, will be more pre-stressed than the reinforced composite material along a length section, LT, adjacent to that length LC, when the adhesive has cured;

adhering the reinforced composite material to the structural member in the pre- stressed state;

indirectly applying a pre-stressing force to the reinforced composite material by attaching at least one protrusion, such as at least one stop block or at least one series of stop blocks, to the reinforced composite material, by adhesion for example, providing a mould comprising at least one recess having a side wall, whereby said at least one recess is arranged to receive said at least one protrusion and the side wall of said at least one recess is arranged to come into contact with said at least one protrusion at some stage during the application of the pre-stressing force, and applying a pre-stressing force to the mould whereby the pre-stressing force is transferred to the reinforced composite material via the action of the side wall(s) of said at least one recess of the mould on said at least one protrusion.

12. The method according to claim 11, wherein said mould comprises a plurality of said recesses, such as three to ten recesses, whereby the width of each recess increases in the direction of application of the pre-stressing force.

13. The method Meshed according to claim 11, wherein said mould is a polylithic structure that enables at least one side wall to be releasably or non-releasably secured in more than one position along the mould.

14. The method according to claim 11, wherein the reinforced composite material is a carbon fiber reinforced polymer (CFRP).

15. The method according to claim 11, comprising fast curing the adhesive between the reinforced composite material and the structural member.

16. The method according to claim 11, comprising curing the adhesive between the reinforced composite material and the structural member at ambient temperature.

* * * * *